US007600482B2

(12) United States Patent
Brun

(10) Patent No.: US 7,600,482 B2
(45) Date of Patent: Oct. 13, 2009

(54) STEERING WHEEL FOR BOAT RUDDER

(75) Inventor: Giancarlo Brun, Thiene (IT)

(73) Assignee: Paolo Sartori, Zane (IT)

( * ) Notice: Subject to any disclaimer, the term of this patent is extended or adjusted under 35 U.S.C. 154(b) by 0 days.

(21) Appl. No.: 10/512,818

(22) PCT Filed: Sep. 23, 2002

(86) PCT No.: PCT/IT02/00607

§ 371 (c)(1),
(2), (4) Date: Oct. 14, 2005

(87) PCT Pub. No.: WO03/024785

PCT Pub. Date: Mar. 27, 2003

(65) Prior Publication Data

US 2006/0090683 A1 May 4, 2006

(30) Foreign Application Priority Data

Sep. 21, 2001 (IT) ..... VI2001A0199

(51) Int. Cl.
*B63H 25/52* (2006.01)
*B62D 1/10* (2006.01)

(52) U.S. Cl. ..... 114/144 R; 74/552; 74/554; 74/555

(58) Field of Classification Search ..... 114/114 R, 114/154, 155, 156, 157, 158, 159, 160, 161; 74/552, 554, 555
See application file for complete search history.

(56) References Cited

U.S. PATENT DOCUMENTS

| | | | | | |
|---|---|---|---|---|---|
| 1,002,663 | A | * | 9/1911 | Fest, Jr. | 74/555 |
| 1,104,524 | A | * | 7/1914 | McKenzie | 74/555 |
| 2,106,169 | A | * | 1/1938 | Erickson | 74/555 |
| 2,155,123 | A | * | 4/1939 | Gerardy | 74/555 |
| 2,889,714 | A | * | 6/1959 | Romano | 74/493 |
| 3,144,785 | A | * | 8/1964 | Steiner et al. | 74/493 |
| 3,165,942 | A | * | 1/1965 | Steiner et al. | 74/493 |

FOREIGN PATENT DOCUMENTS

| | | |
|---|---|---|
| DE | 38 08 237 | 9/1989 |
| EP | 0 250 375 | 12/1987 |
| EP | 0 749 893 | 12/1996 |
| FR | 2 771 997 | 6/1997 |

* cited by examiner

*Primary Examiner*—Sherman Basinger
(74) *Attorney, Agent, or Firm*—Dykema Gossett PLLC

(57) ABSTRACT

A steering wheel for a boat rudder, which can be mounted on a rudder actuating shaft, comprising a substantially circular body (2) with an external peripheral edge (3) for gripping by a user and a central hub (4) defining an axis of rotation (L), characterized in that the body (2) is formed by a plurality of circle portions (5) which are movable with respect to each other, so as to pass selectively from an open operative configuration, where the circle portions (5) are adjacent and contained in a main plane of extension, to a closed rest configuration, where the circle portions (5) are at least partly superimposed so as to limit the volume in the main plane of extension, and vice versa. Owing to this particular arrangement it will be possible to increase the available space onboard the boat when the rudder is not used and, in so doing, facilitate the movements of the crew.

17 Claims, 10 Drawing Sheets

STEERING WHEEL FOR BOAT RUDDER

TECHNICAL FIELD

The present invention relates to the nautical field and in particular relates to a steering wheel for rudders of boats of various types and dimensions, i.e. sailing boats or motorboats.

BACKGROUND ART

A steering wheel for a boat rudder may have different dimensions depending on the type and dimensions of the craft and may sometimes hinder the movements of persons on-board.

U.S. Pat. No. 5,048,444 describes a rudder wheel for boats which is mounted rotatably on a support column by means of a suitable pivot, having a longitudinal axis parallel to the stern-prow direction of the boat itself. This pivot is formed by two portions which are aligned and fastened together by means of a rotational coupling having a direction of rotation substantially perpendicular to the pivot itself. In this way the wheel of the rudder can be rotated from the operative position into an angular rest position, laterally with respect to the support column.

A drawback of this solution consists in the fact that the overall volume of the rudder wheel is not reduced since the wheel is simply rotated. In particular, in the rotated rest position, the available space close to the support column in the transverse direction is increased, but at the same time the free space in the longitudinal direction is decreased.

In field other than the nautical one, for example in the motor-car field, numerous applications aimed at reducing the volume of the driving or steering devices are known. In particular, U.S. Pat. No. 5,199,319 describes a steering device for a vehicle, comprising a wheel mounted axially on a rotatable steering shaft. The steering device comprises adjusting means for varying the inclination and the length of the rotatable steering shaft, so as to adjust the inclination and the axial position of the steering wheel and find the most comfortable configuration. A similar device could also be used in the nautical field in order to vary the length and the inclination of the column which supports the rudder steering wheel.

The application of this solution to boats would make it possible to find the optimum position for use of the steering wheel, but would be unlikely to achieve a significant reduction in the overall volume.

JP-58030867 describes a steering wheel for motor vehicles having a circular rim supported by three spokes converging towards the rotatable shaft of the steering system. The circular rim is divided into three segments, each of which is fastened to a respective spoke. Each spoke is connected to the rotatable shaft by means of a rotational coupling having an axis of rotation perpendicular to the shaft itself. In this way it is possible to fold a spoke and the respective rim segment towards the inside of the steering wheel and reduce the volume of the steering wheel itself, for example in order to facilitate entry into and exit from the motor vehicle.

This solution could also be applied in the nautical field to a rudder steering wheel, but would be of limited usefulness since it would allow only one segment of the rim to be folded. In so doing, the volume of the steering wheel would be reduced on one side only and the non-folded portion of the wheel would continue to hinder movements on-board.

SUMMARY OF THE INVENTION

A primary object of the present invention is to eliminate the drawbacks mentioned above, by providing a steering wheel for a boat rudder which increases the space available on-board the boat itself and facilitates the movements of the crew when the rudder is not used.

A particular object is that of providing a steering wheel which is robust and effective during steering of the boat by a helmsman.

A further object of the invention is that of providing a steering wheel, the volume of which may be reduced in a simple and rapid manner so as to increase the space available for the crew.

Another particular object is that of providing a steering wheel which is safe, free of play or other undesirable movements, both during use and the non-operative phases.

An additional object is that of providing a steering wheel which is practical, robust and cheap.

These objects along with others which will appear more clearly hereinafter, are achieved, in accordance with Claim 1, by a steering wheel for a boat rudder, which can be mounted on a rudder actuating shaft, comprising a substantially circular body with an external peripheral edge for gripping by a user and a central hub defining an axis of rotation, characterized in that the circular body is formed by a plurality of circle portions which are movable with respect to each other, so as to pass selectively from an open operative configuration, where the circle portions are adjacent and contained in a main plane of extension, to a closed rest configuration, where the circle portions are at least partly superimposed so as to limit the volume in the main plane of extension, and vice versa.

Owing to this particular arrangement it will be possible to increase the space available on-board the boat when the rudder is not used, and in so doing, facilitate the movements of the crew.

Preferably, the hub comprises a plurality of constraining elements, to each of which a respective circle portion is fastened. One of the constraining elements is fixed with respect to the rudder actuating shaft, while the other elements are movable with respect to the fixed element coaxially relative to the axis of rotation. Moreover, the constraining elements have guiding means able to impart to the them relative rotational translatory movements with respect to the axis of rotation.

Owing to this particular embodiment it will be possible to convert the wheel from the open operative configuration into the closed rest configuration and vice versa in a simple and rapid manner.

Suitably, the hub comprises means for selectively locking the position of the central constraining elements relative to each other, both in the open operative configuration and in the closed rest configuration. Moreover, the circular edge advantageously consists of circular rim arcs connected to respective constraining elements by means of one or more substantially radial spokes. The adjacent circular rim arcs may be fastened at their ends by means of suitable coupling means.

Owing to these particular features, it will be possible to obtain a steering wheel which is robust, safe and free of play or other undesirable movements both during use by a user and during the non-operative phases.

BRIEF DESCRIPTION OF THE DRAWINGS

Further features and advantages of the invention will be more clearly understood from the detailed description of some preferred, but not exclusive embodiments of a steering wheel according to the invention, illustrated by way of a non-limiting example with the aid of the accompanying plates of drawings in which.

DETAILED DESCRIPTION OF THE PREFERRED EMBODIMENT(S)

Figure 1:
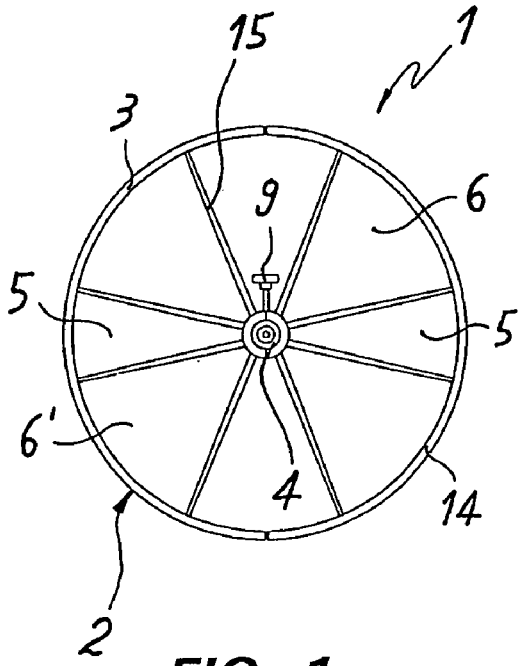
FIG. 1 shows a front view of a first embodiment of an steering wheel according to the invention.
Figure 2:
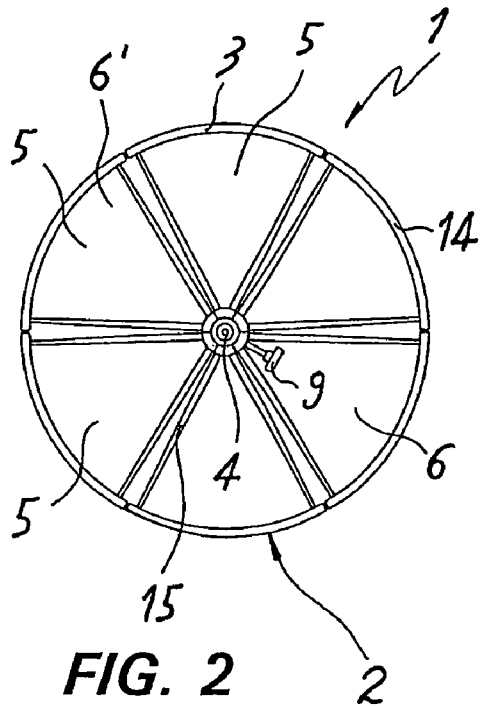
FIG. 2 shows a front view of a second embodiment of a steering wheel according to the invention.

With particular reference to the above figures, a steering wheel according to the invention, generally identified with reference number 1, is described.

The steering wheel 1 can be mounted on an actuating shaft of a rudder for boats so as to allow a user to determine easily the route of the boat itself. The boats on-board which the steering wheel 1 may be advantageously used, may be of various types and dimensions, i.e. sailing boats or exclusively propeller-driven boats.

The wheel 1 comprises a body 2 which is substantially circular with an external peripheral edge 3 for gripping by a user and a central hub 4 defining an axis of rotation L. The central body 2 is formed by a plurality of circle portions 5 which are movable with respect to each other. In this way the wheel 1 is able to pass from an open operative configuration, where the circle portions 5 are adjacent and contained in a main plane of extension, to a closed rest configuration, where the circle portions 5 are at least partially superimposed so as to limit the volume in the main plane of extension. The conversion from the open operative configuration into the closed rest configuration is completely reversible and may be inverted in a simple manner.

Each circle portion 5 may comprise at least one circle segment 6 with a predetermined angular amplitude, and more particularly, each circle portion 5 may consist of a pair of circle segments 6, 6' which are diametrically opposite and symmetrical with respect to the axis of rotation L.

In the closed rest configuration, each pair of circle segments 6, 6' is placed in the superimposed condition with respect to the other pairs of segments 6, 6'. In these conditions there is the maximum reduction in the main plane of extension when all the circle segments 6, 6' have the same angular extension. However, in the open operative configuration the circle segments 6, 6' cover overall a complete round angle. Therefore, the angular extension of each circle segment 6, 6' may be determined by dividing the round angle by the total number of segments 6, 6' which are used.

The hub 4 comprises a plurality of constraining elements 7, 7', to each of which a respective circle portion 5 or a respective pair of circle segments 6, 6' is fastened. One constraining element 7 is fixed with respect to the actuating shaft of the rudder, so as to transmit to the latter the commands imparted by the helmsman, while the other elements 7' are movable, coaxially relative to the axis of rotation L, with respect to the fixed element 7.

The relative movements of the constraining elements 7, 7' are guided by suitable guiding means 8 associated with the said constraining elements. In this way, the guiding means 8 allow relative rotation-translation movements, with respect to the axis of rotation L, to be imparted to the constraining elements 7, 7'.

The hub 4 comprises locking means 9 for selectively locking the position of the constraining elements 7, 7' relative to each other, both in the open operative configuration and in the closed rest configuration. In this way, in the open operative configuration the circle portions 5 or the pairs of circle segments 6, 6' cover the entire round angle and are all fixed relative to each other, allowing the helmsman to operate any one of them manually. Moreover, the relative movements of the constraining elements 7, 7' are also locked in the closed rest configuration and, as a result, the circle portions 5 or the pairs of circle segments 6, 6' cannot accidentally move with respect to each other, for example owing to the pitching movements of the boat when moored.

Suitably, the guiding means 8 comprise at least one substantially cylindrical portion 10 of suitable axial extension, formed on each constraining element 7, 7'. The cylindrical portion 10 of each constraining element 7, 7' is able to come into contact at least partially with the cylindrical portion 10 of an adjacent constraining element 7, 7', making possible a relative rotation-translation movement of the pair of constraining elements 7, 7' making contact with each other.

In particular, the cylindrical portion 10 of at least one constraining element 7, 7' comprises a groove 11 which has an axial section and a circumferential section and is able to interact with a radial projection 12 associated with one or more adjacent constraining elements 7, 7'. The engagement between the groove 11 of a constraining element 7, 7' and the radial projection 12 associated with an adjacent constraining element 7, 7' forms a cylindrical cam able to impart to the two constraining elements 7, 7' involved a relative translatory and rotational movement of predetermined axial and angular amplitude. For greater ease of manufacture, the radial projection 12 associated with a constraining element 7, 7' may consist of an end of the locking means 9 which engages with the constraining element itself.

Figure 4:
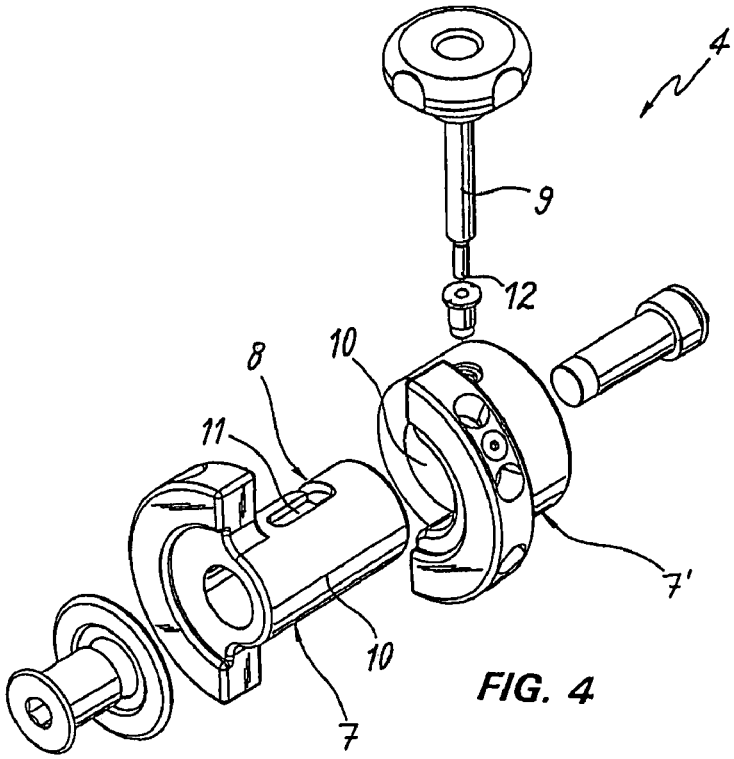
FIG. 4 shows an exploded perspective view of the hub of the wheel according to FIG. 1.
Figure 4A:
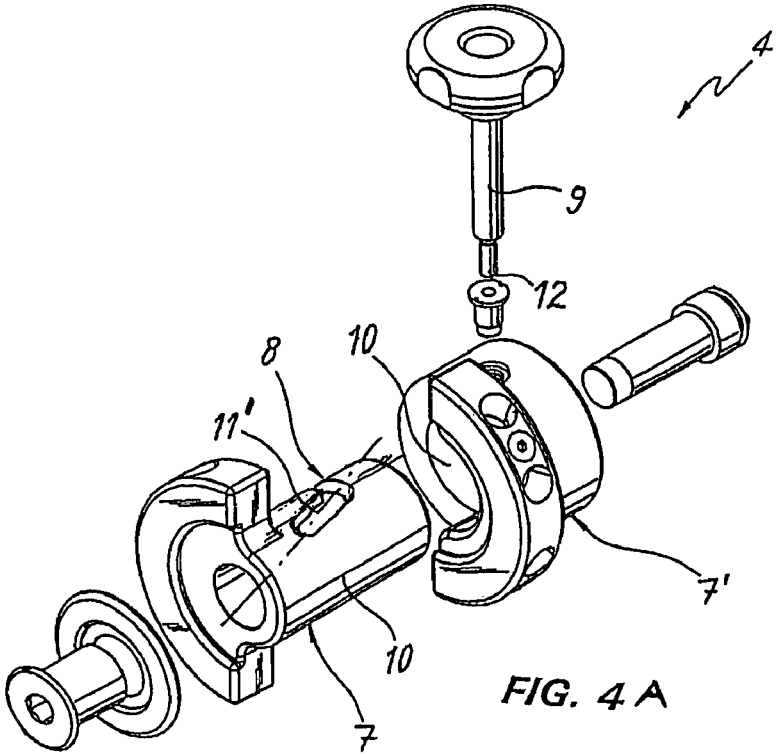
FIG. 4A shows an exploded perspective view of a modified hub.
Figure 5:
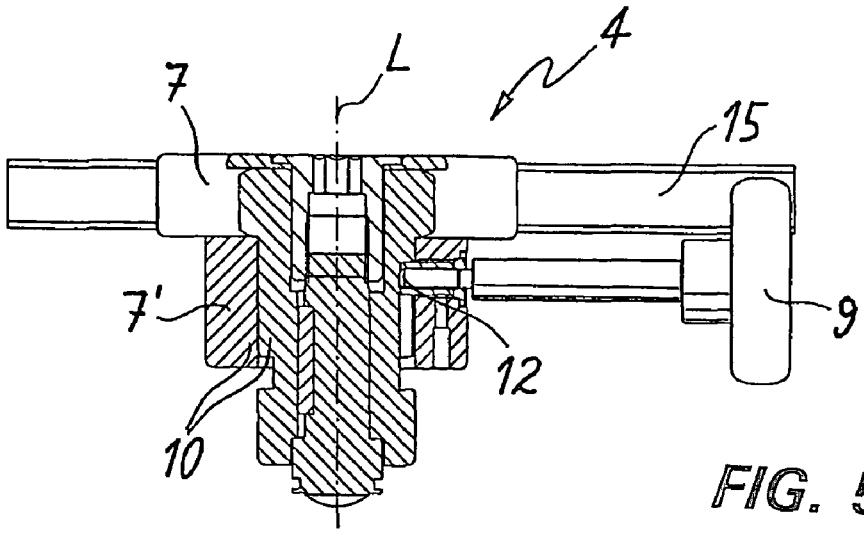
FIGS. 5 to 7 show sectioned side views of the hub according to FIG. 4, respectively in an open operative configuration, in an intermediate configuration and in a closed rest configuration.
Figure 6:
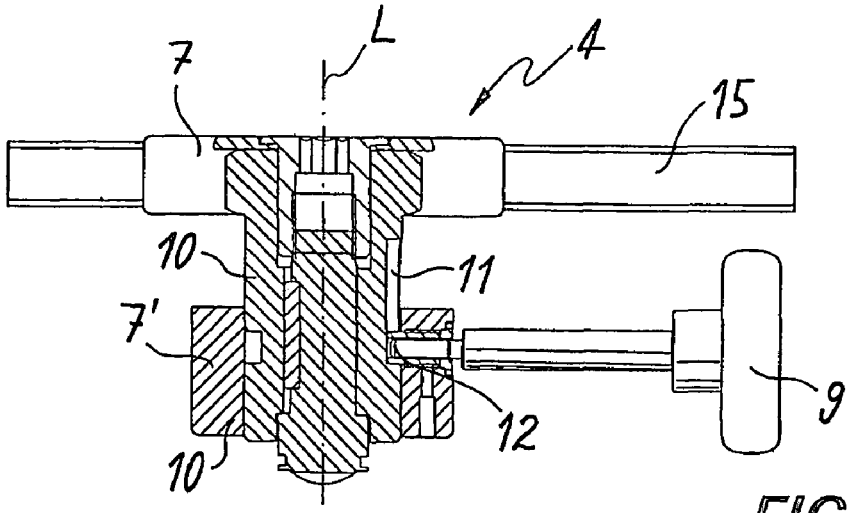
Figure 7:
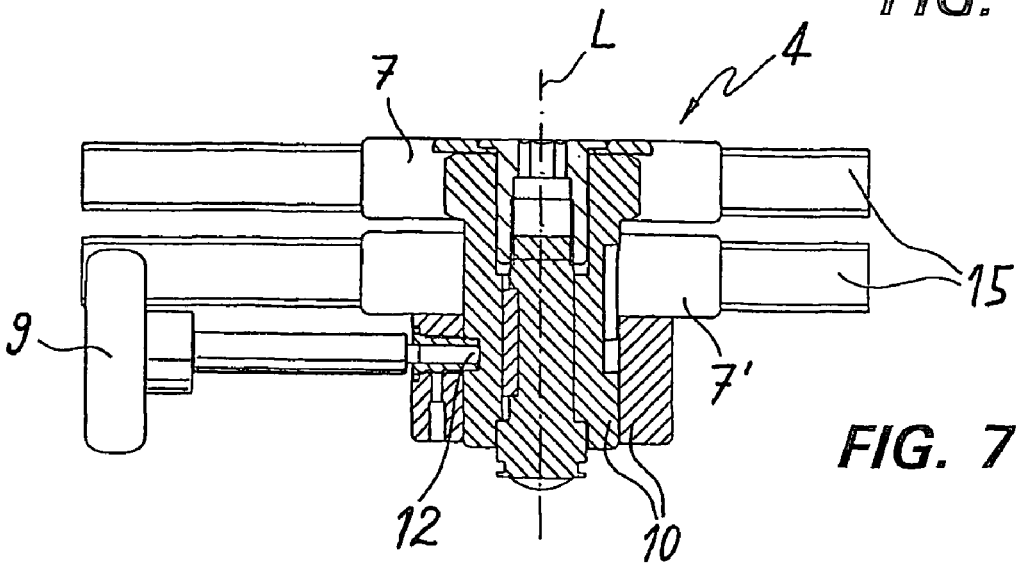
Figure 8:
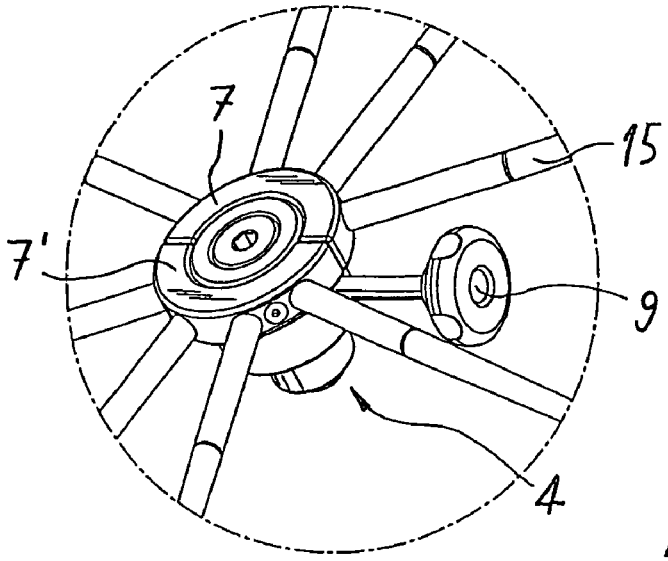
FIGS. 8 to 10 show enlarged perspective views of the hub according to FIG. 4, respectively in an open operative configuration, in an intermediate configuration and in a closed rest configuration.
Figure 9:
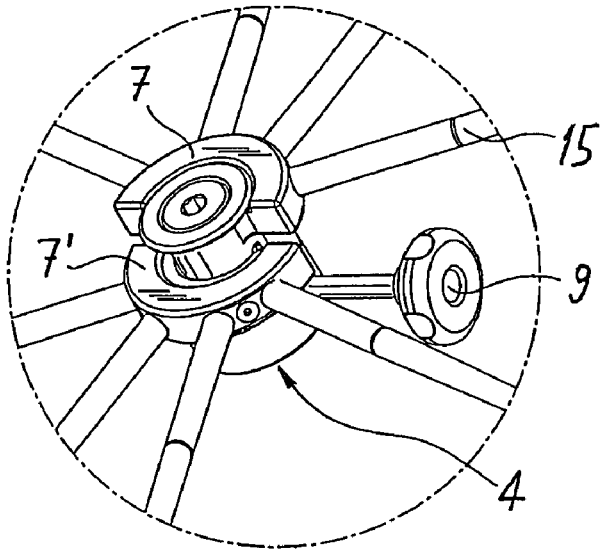
Figure 10:
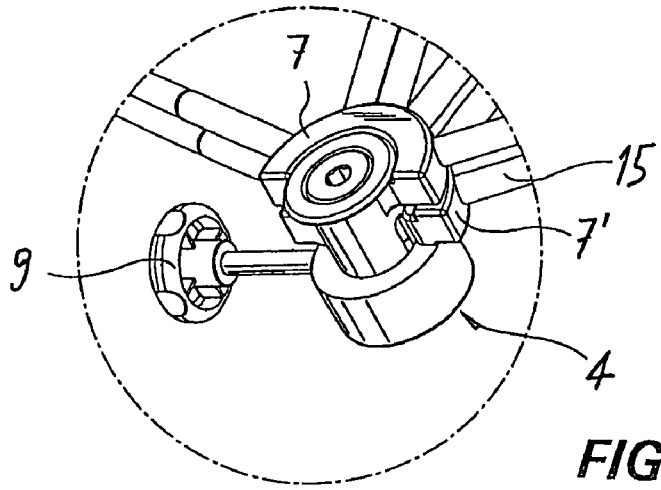
Figure 11:
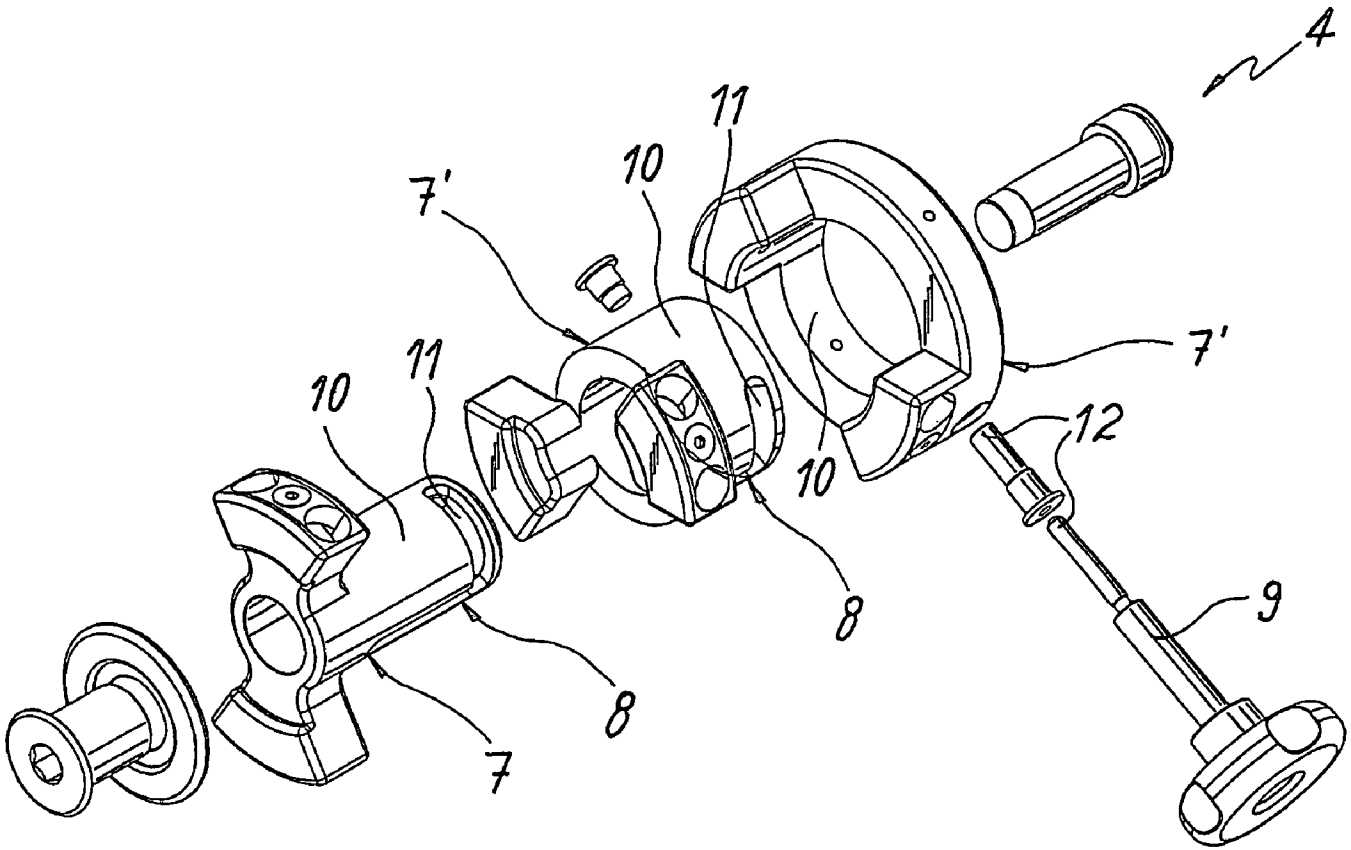
FIG. 11 shows an exploded perspective view of the hub of the wheel according to FIG. 2.
Figure 12:
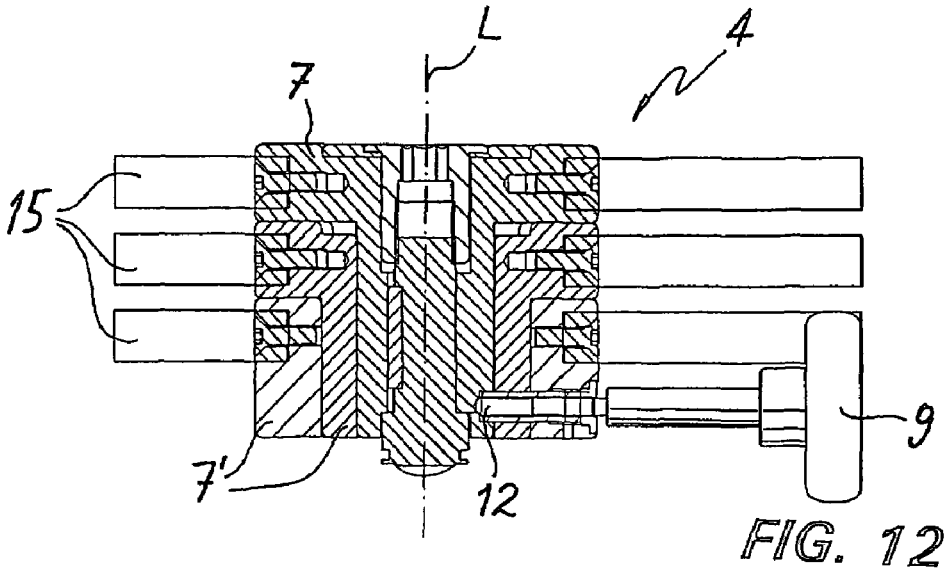
FIGS. 12 to 14 show sectioned side views of the hub according to FIG. 11, respectively in the closed rest configuration, in an intermediate configuration and in an open operative configuration.
Figure 13:
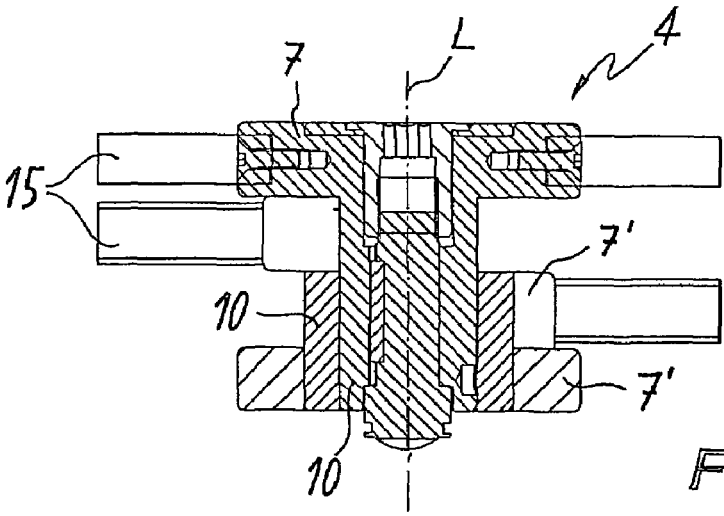
Figure 14:
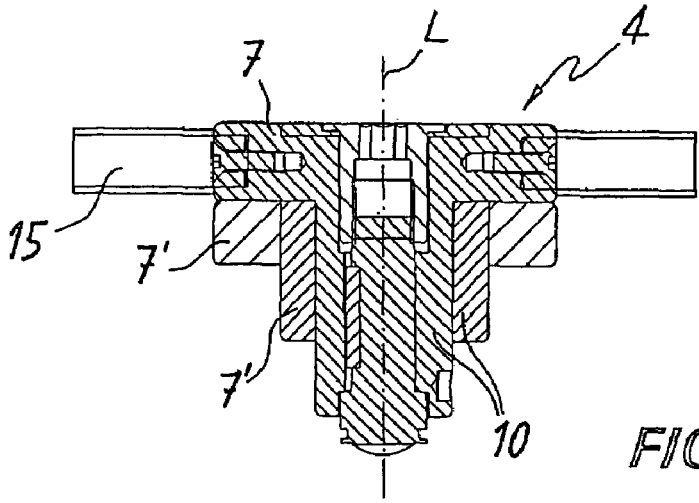
Figure 15:
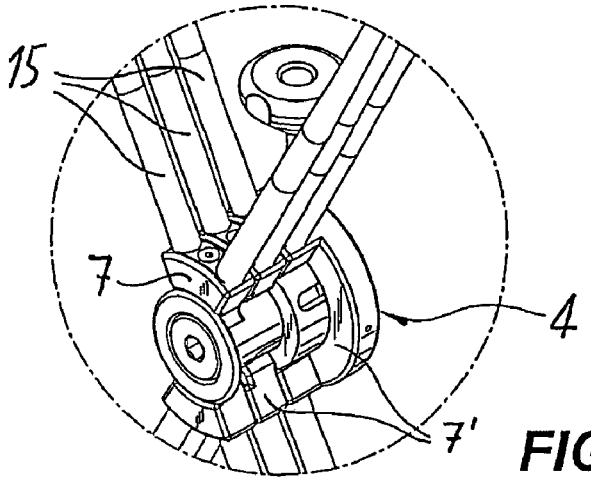
FIGS. 15 to 17 show enlarged perspective views of the hub according to FIG. 11, respectively in a closed rest configuration, in an intermediate configuration and in an open operative configuration.
Figure 16:
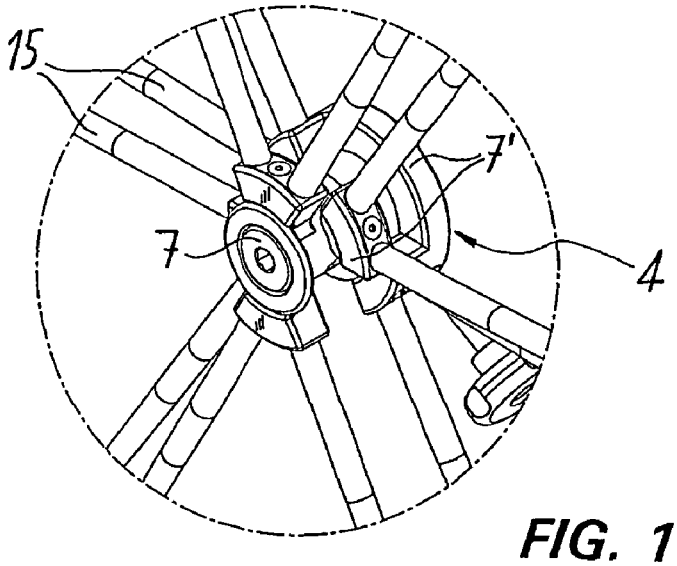
Figure 17:
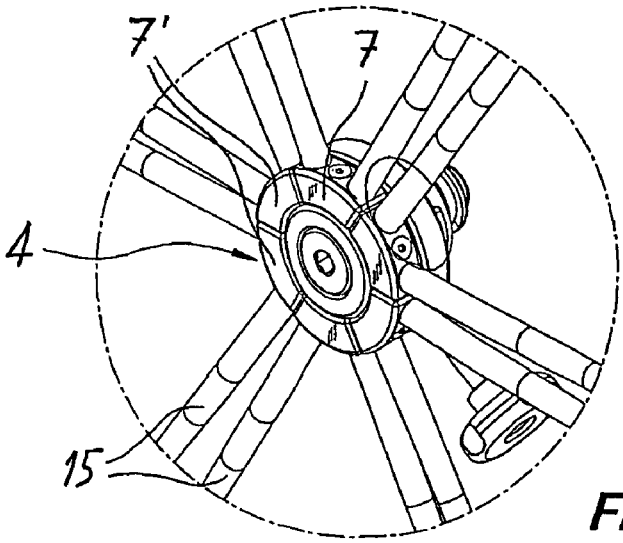
Figure 18:
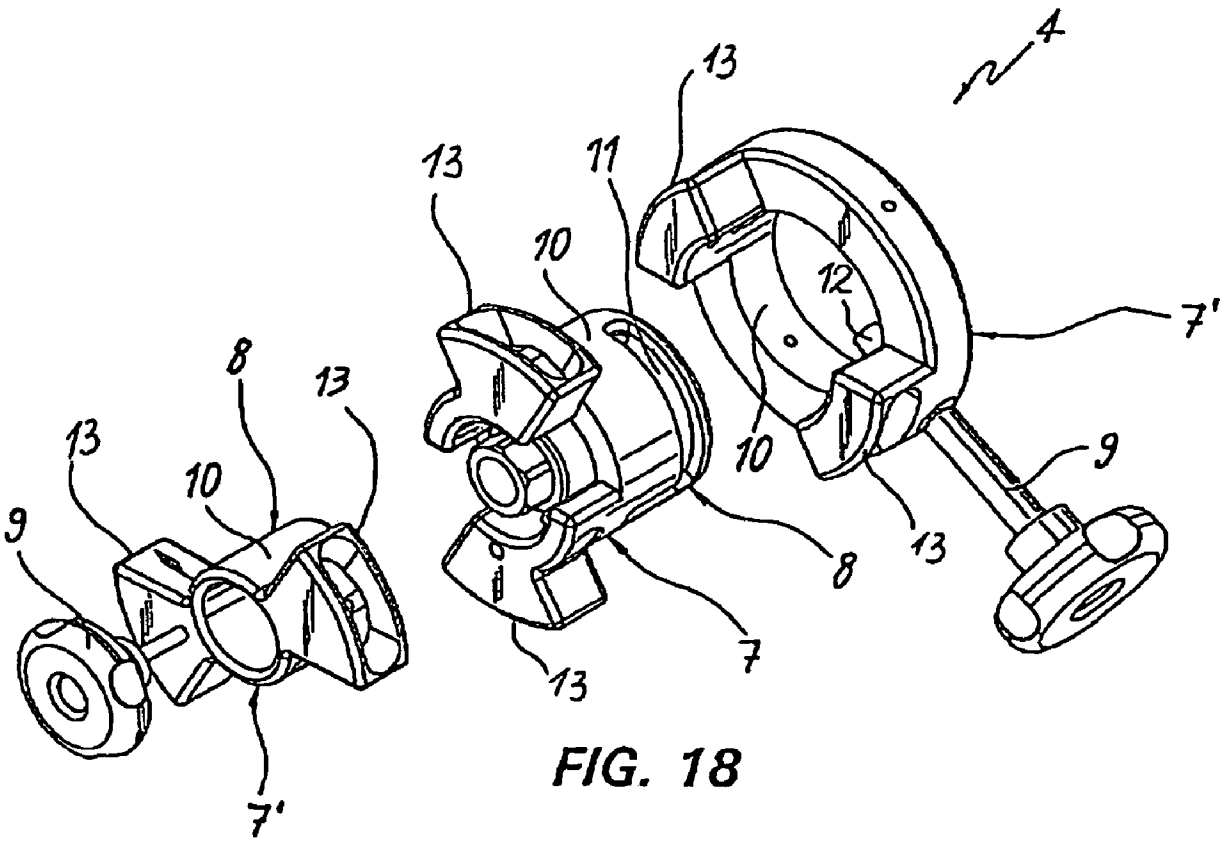
FIG. 18 show an exploded perspective view of the hub of a steering wheel according to the invention.
Figure 19:
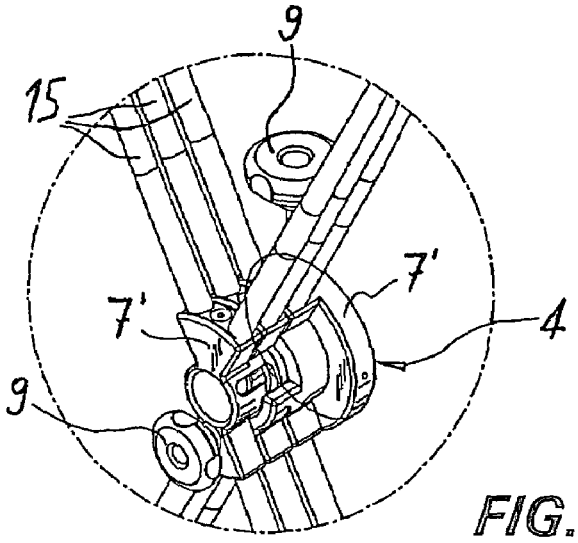
FIGS. 19 to 21 show enlarged perspective views of the hub according to FIG. 18, respectively in a closed rest configuration, in an intermediate configuration and in an open operative configuration.
Figure 20:
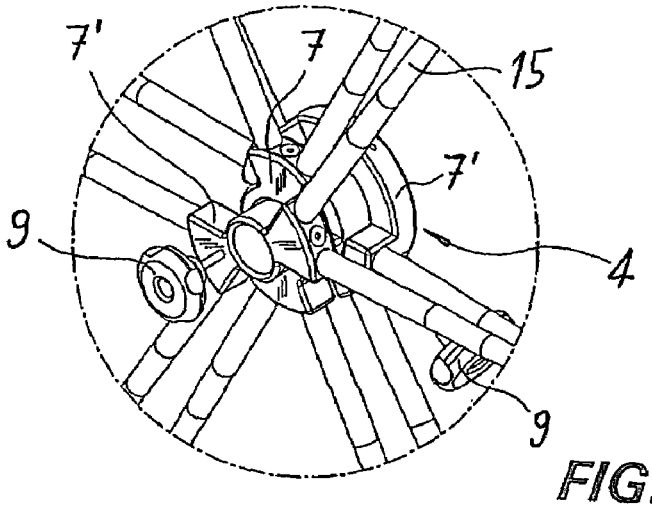
Figure 21:
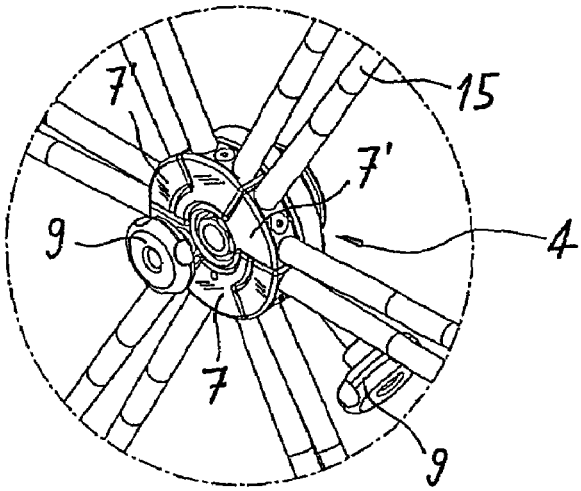
Figure 22:
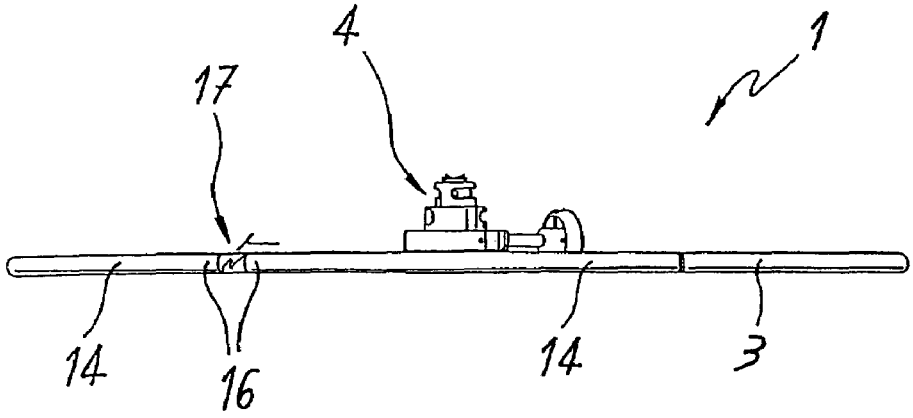
FIG. 22 shows a side view of a steering wheel according to the invention.
Figure 23:
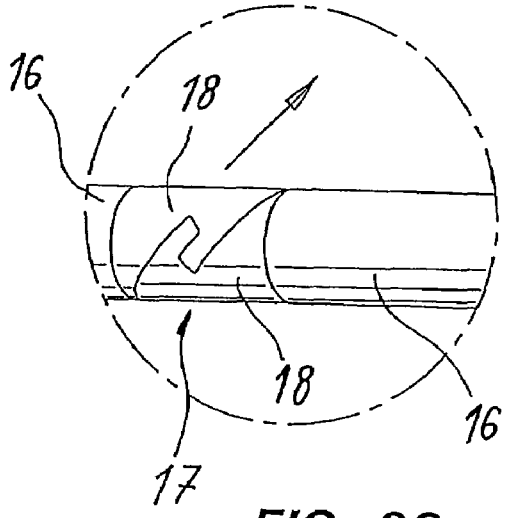
FIG. 23 shows an enlarged view of a detail of FIG. 22.
Figure 24:
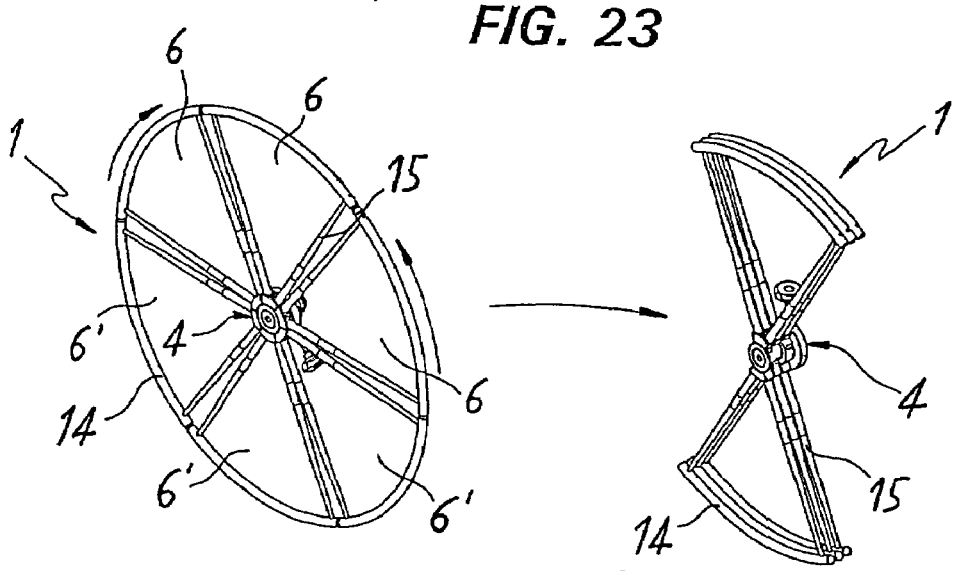
FIG. 24 shows a perspective view of the wheel according to FIG. 2, respectively in an open or expanded operative configuration and in a closed rest configuration.

Suitably, the groove 11 may be of the helical type; 11' (see FIG. 4A) so as to impart a helical relative movement with a helical pitch of predetermined amplitude to the constraining elements 7, 7' forming the cam coupling thus obtained.

Two adjacent constraining elements 7, 7', when they are not fastened to each other by means of a cam-type coupling between a groove 11 and a radial projection 12, could be subject to relative axial sliding as a result of the contact between their respective cylindrical portions 10, having an extension such as to produce separation between the two elements, and the consequent undesirable separation of a circle portion 5 or a pair of circle segments 6, 6' from the circular body 2. In order to prevent such a possibility from arising, the cylindrical portion 10 of at least one constraining element 7, 7' may have at least one radial shoulder 13 directed towards the inside and/or towards the outside and able to limit the axial relative displacement of one or more adjacent constraining elements 7, 7'.

Advantageously, the external peripheral edge 3 may consist of arcs 14 of a circular rim, which are connected to respective constraining means 7, 7' of the hub 4 by means of one or more substantially radial spokes 15.

In order to increase the rigidity of the wheel 1 in its open operative configuration and to improve the sensation of robustness when it is gripped by a user, the adjacent circular rim arcs 14 may be fastened at their ends 16 by means of suitable coupling means 17. In particular, the coupling means 17 comprise a pair of joints 18, each of which has the function of fastening together a respective pair of adjacent circular rim arcs 14. Each end 16 of a circular rim arc 14 has a joint 18 able to engage selectively with a corresponding joint 18 of complementary shape and integral with an adjacent arc 14, as a result of the relative movement of the respective pairs of circle segments 6, 6'.

Figure 3:
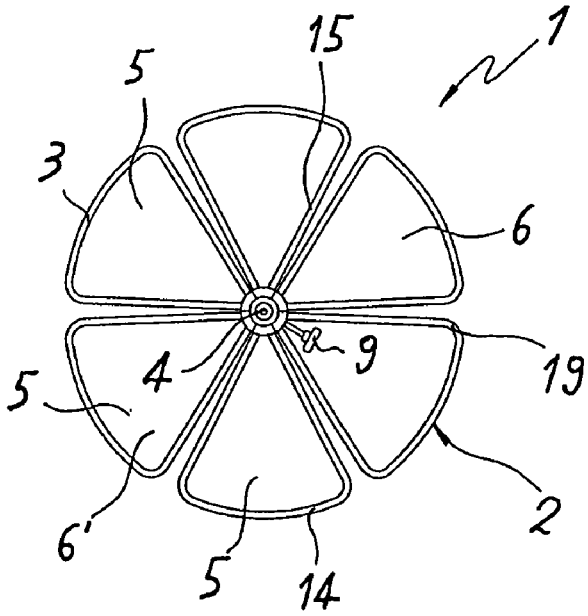
FIG. 3 shows a front view of a third embodiment of a steering wheel according to the invention.

In a preferred embodiment shown in FIG. 3, the circular rim arc 14 of each circle segment 6, 6' forms one piece with a respective pair of spokes 15 of the same circle segment 6, 6'. Moreover, the joining angles 19 between the circular rim arc 14 of each circle segment 6, 6' and the respective pair of spokes 15 may be rounded.

Suitably, the wheel 1 comprises a ball joint (not shown in the drawings) having one end connected to the hub and the other end which can be connected to the rudder actuating shaft, in order to vary the inclination between the latter and the axis of rotation L.

The conversion of the wheel 1 from the open operative configuration into the closed rest configuration is performed using a method for reducing the volume of the said wheel, comprising a sequence of successive operations.

The movable constraining elements 7' are initially subjected to a sequence of rotational and translatory movements with respect to the fixed constraining element 7 so as to bring the circle portions 5 or the pairs of circle segments 6, 6' into the superimposed position. Then the circle portions 5 or the pairs of circle segments 6, 6' are locked with respect to the fixed constraining element 7 by operating the locking means 9.

In particular, the succession of rotational translatotory movements may comprise a first series of axial translatory movements of the movable constraining elements 7' with respect to the fixed constraining element 7, followed by a second series of rotations of the movable constraining element 7' with respect to the fixed constraining element 7.

The axial translatory movements of the first series are all performed in the same direction, in a preferred example of embodiment of the wheel 1, shown in FIGS. 11 to 17, while they are performed in opposite directions with respect to the fixed constraining element 7, in a second example of embodiment, shown in FIGS. 18 to 21.

Advantageously, the succession of rotational and translatory movements may be performed by actuating a circle portion 5 or a pair of movable circle segments 7' at the same time. In this case, one or more translatory movements alternating with one or more rotations of each movable constraining element 7' are performed.

Suitably, the succession of rotational and translatory movements may comprise a plurality of helical movements of the movable constraining elements 7' with respect to the fixed constraining element 7.

From that described above it is obvious that the steering wheel according to the invention achieves the predefined objects and in particular the form of the hub constraining elements, to which the circle portions or the pairs of circle segments are connected, allows a reduction in the volume of the wheel in a simple and rapid manner so as to increase the space available for the crew. Moreover, the presence of the hub locking means and, suitably, the means for coupling the adjacent circular rim arcs result in a steering wheel which is robust and devoid of play or other undesirable movements.

The steering wheel according to the invention may be subject to numerous modifications and variations all falling within the inventive idea expressed in the accompanying claims. All the details may be replaced by other technically equivalent elements and the materials may be different depending on the requirements, without departing from the scope of the invention.

Although the steering wheel has been described with particular reference to the accompanying figures, the reference numbers used in the description and in the claims are used in order to improve the comprehensibility of the invention and do not impose any limitation on the scope of protection claimed.

The instant application is based upon and claims priority of patent application Ser. No. VI2001A000199, filed on 21 Sep. 2001 in Italy, the disclosure of which is hereby expressly incorporated here in reference thereto.

The invention claimed is:

1. A steering wheel for a boat rudder, which can be mounted on a rudder actuating shaft, comprising a substantially circular body with an external peripheral edge for gripping by a user and a central hub defining an axis of rotation, wherein said body is formed by a plurality of circle portions which are movable with respect to each other by means of a translation along a direction substantially parallel to the rotation axis, and a rotation around the rotation axis, so as to pass selectively from an open operative configuration, where said circle portions are adjacent and contained in a main plane of extension, to a closed rest configuration, where said circle portions are at least partly superimposed so as to limit the volume in said main plane of extension, and vice versa.

2. The steering wheel according to claim 1, wherein said hub comprises a plurality of constraining elements, one of said elements being fixed with respect to the rudder actuating shaft, while the other elements are movable with respect to said fixed element coaxially relative to said axis of rotation, each of said circle portions being fastened to a respective constraining element.

3. The steering wheel according to claim 2, wherein said constraining elements have guiding means able to impart to them relative rotational translatory movements with respect to said axis of rotation.

4. The steering wheel according to claim 3, wherein said guiding means comprise at least one substantially cylindrical portion of suitable axial extension formed on each of said constraining elements.

5. The steering wheel according to claim 4, wherein the cylindrical portion of at least one of said constraining elements comprises a groove able to interact with a radial projection associated with one or more adjacent constraining elements so as to impart thereto a relative translational and rotary movement of predetermined axial and angular amplitude.

6. The steering wheel according to claim 5, wherein said groove comprises an axial section and a circumferential section.

7. The steering wheel according to claim 5, wherein said groove is of the helical type.

8. The steering wheel according to claim 3, wherein said hub comprises locking means for locking selectively the position of said constraining elements relative to each other, both in said open operative configuration and in said closed rest configuration.

9. The steering wheel according to claim 2, wherein said external peripheral edge is formed by circular rim arcs connected to respective constraining elements of said hub by means of one or more substantially radial spokes.

10. The steering wheel according to claim 9, wherein the adjacent circular rim arcs are fastened in said open operative configuration by means of suitable coupling means provided at their ends.

11. The steering wheel according to claim 1, wherein said circle portions comprise at least one circle segment of predetermined angular amplitude.

12. The steering wheel according to claim 11, each of said circle portions comprise a pair of circle segments diametrically opposite and symmetrical with respect to said axis of rotation.

13. The steering wheel according to claim 12, wherein said circle segments have the same angular extension such that in the open operative configuration they cover overall a complete round angle.

14. A method for reducing the volume of a circular steering wheel in which the wheel comprises a substantially circular body formed of a plurality of circle portions and a central hub defining an axis of rotation, the hub comprising a plurality of constraining elements, one of which is fixed on the rudder actuating shaft and the other constraining elements being movable with respect to the fixed constraining element, comprising the steps initially subjecting the constraining elements to a sequence of rotational and translatory movements with respect to the fixed constraining element, said translatory movements occurring in a direction substantially parallel to said axis of rotation, so as to bring the wheel into a closed rest configuration, substantially symmetrical with respect to said axis of rotation, and locking the constraining elements with respect to the fixed constraining element in said closed rest configuration, and wherein the succession of rotational and translatory movements comprises a first series of axial translatory movements of the movable constraining elements with respect to the fixed constraining element, followed by a second series of rotations of the movable constraining elements with respect to the fixed constraining element.

15. The method according to claim 14, wherein the axial translatory movements of the first series occur respectively in the same direction and in opposite directions relative to said fixed constraining element.

16. A method for reducing the volume of a circular steering wheel in which the wheel comprises a substantially circular body formed of a plurality of circle portions and a central hub defining an axis of rotation, the hub comprising a plurality of constraining elements, one of which is fixed on the rudder actuating shaft and the other constraining elements being movable with respect to the fixed constraining element, comprising the steps initially subjecting the constraining elements to a sequence of rotational and translatory movements with respect to the fixed constraining element, said translatory movements occurring in a direction substantially parallel to said axis of rotation, so as to bring the wheel into a closed rest configuration, substantially symmetrical with respect to said axis of rotation, and locking the constraining elements with respect to the fixed constraining element in said closed rest configuration, wherein the succession of rotational and translatory movements comprises one or more translatory movements alternating with one or more rotations of each of said movable constraining elements.

17. A method for reducing the volume of a circular steering wheel in which the wheel comprises a substantially circular body formed of a plurality of circle portions and a central hub defining an axis of rotation, the hub comprising a plurality of constraining elements, one of which is fixed on the rudder actuating shaft and the other constraining elements being movable with respect to the fixed constraining element, comprising the steps initially subjecting the constraining elements to a sequence of rotational and translatory movements with respect to the fixed constraining element, said translatory movements occurring in a direction substantially parallel to said axis of rotation, so as to bring the wheel into a closed rest configuration, substantially symmetrical with respect to said axis of rotation, and locking the constraining elements with respect to the fixed constraining element in said closed rest configuration, wherein the succession of rotational translatory movements comprises a plurality of helical movements of the movable constraining elements with respect to the fixed constraining element.

* * * * *